United States Patent [19]

Hwang

[11] Patent Number: 4,679,031

[45] Date of Patent: Jul. 7, 1987

[54] DEVICE TO FACILITATE THE ARMING OF AN ALARM SYSTEM AND TO PROVIDE LOCK-OUT PROTECTION

[76] Inventor: Shih-Ming Hwang, No. 11, Alley 12, Lane 7, Ching-Tyan St., Taipei, Taiwan

[21] Appl. No.: 770,752

[22] Filed: Aug. 29, 1985

[51] Int. Cl.[4] ..... G08G 23/00; E05B 45/06

[52] U.S. Cl. ..... 340/501; 340/542; 340/543; 340/527; 340/528; 361/171; 361/172; 70/267; 70/268

[58] Field of Search ..... 340/501, 542, 543, 527, 340/528, 825.31, 825.5; 361/89, 94–96, 171, 172; 70/267, 268, 266, 315, 333 R, 334, 382, 383, 385

[56] References Cited

U.S. PATENT DOCUMENTS

| | | | |
|---|---|---|---|
| 3,755,776 | 8/1973 | Kotras | 340/543 |
| 4,095,239 | 6/1978 | Gerry | 340/543 |
| 4,258,346 | 3/1981 | Williams | 340/543 |
| 4,258,358 | 3/1981 | Lee et al. | 340/543 |
| 4,333,090 | 6/1982 | Hirsch | 340/543 |

OTHER PUBLICATIONS

"Seco-Larm", Superior Electronics Corporation, Taiwan, Jan. 30, 1987.

"Original Car Gard", Ljunggren & Riise, Lidingo, Sweden, Jan. 30, 1987.

*Primary Examiner*—Donnie L. Crosland

*Attorney, Agent, or Firm*—Lane and Aitken

[57] ABSTRACT

A burglarproof device which can facilitate the activation of an alarm system and can provide lock-out protection. It uses a set of correct-signal generating reed switches and a set of incorrect-signal generating reed switches to activate the alarm signal, and the input of a correct signal within the preset lock-out time after receipt of an incorrect signal will not be able to open the door lock or disarm the alarm system.

3 Claims, 2 Drawing Figures

DEVICE TO FACILITATE THE ARMING OF AN ALARM SYSTEM AND TO PROVIDE LOCK-OUT PROTECTION

BACKGROUND OF THE INVENTION

Present systems include a set of reed swtiches connected in parallel which generates an incorrect signal together with a set of reed switches connected in series which generates a correct signal to burglar-proof an alarm. With this arrangement, an alarm system can be disarmed and a door lock can be opened by turning on the set generating the correct signal, but input from the incorrect set will cause circuit to lock out. Though such a combination of reed switches can burglar-proof an alarm to some extent, the door lock can still be opened without tripping the alarm if a thief uses a third set of magnets. Because of this defect, the present invention has been designed to facilitate the activation of an alarm system and to provide lock-out protection.

SUMMARY OF THE INVENTION

The present invention provides a device to facilitate the activation of an alarm system and provide lock-out protection. It uses either correct or incorrect signals to activate the alarm system with an I.D. pad. When the alarm is armed, a correct signal within a preset look-out time after the receipt of any incorrect signal will not be able to open the door lock or disarm the alarm system. In this way, it facilitates the activation of an alarm system and provides lock-out protection.

(1) Incorrect-signal Generating Set (parallel circuit)
(2) Lock-out Timer Circuit
(3) Correct-signal Generating Set (series circuit)
(4) Comparator Circuit
(5) Correct-signal Disable Circuit
(6) Alarm Arming Signal Circuit
(7) Driving Circuit
(8) Alarm System

DESCRIPTION OF THE PREFERRED EMBODIMENT

The present invention is a device to facilitate the activation of an alarm system and provide lock-out protection. It has the following characteristics:

(1) When wishing to arm any alarm system, both correct and incorrect signals from the two sets of reed switches can arm the alarm system, but only correct signals can disarm the alarm and open the lock for a door protected by the alarm system.

(2) While the alarm system is armed, if an incorrect signal is applied, the correct signal will not work within a preset lock-out time.

(3) The lock can be opened and the alarm can be disarmed by a correct signal given after a preset lock-out time following input of an incorrect signal. Imposition of this prset time means it causes considerable delay each time an incorrect signal is generated, thereby effectively tamperproofing the alarm. A detailed description is given below with reference to the attached drawings.

Figure 1:
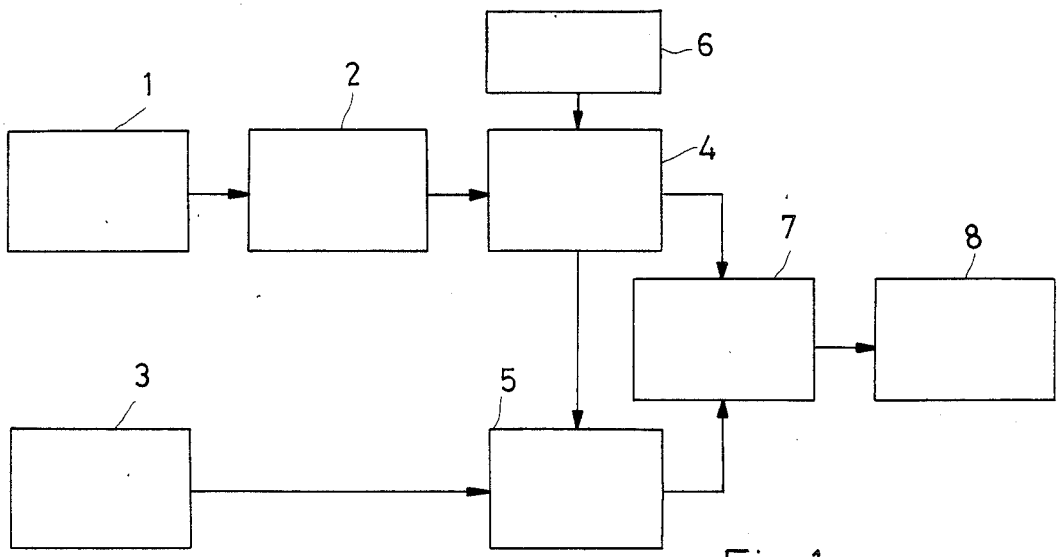
FIG. 1 is a block diagram of the present invention.

FIG. 1 is a block diagram for a preferred embodiment of the present invention. As shown in the figure, the alarm system is armed when a set of reed switches generates a correct signal (3) or a set generates an incorrect signal (1). A signal from the incorrect-signal generating set (1) via the lock-out timer circuit (2), the comparator circuit (4), and the driving circuit (7), or from the correct-signal generating set (3) via the correct-signal disable circuit (5) and the driving circuit (7), activates the alarm system (8). Therefore, it is very easy to activate the alarm system (8) since either the correct-signal generating set (3) or the incorrect-signal generating set (1) can do it. Whenever the alarm system is armed, if there is an incorrect signal from the incorrect-signal generating set (1), the said signal will activate the lock-out timer circuit (2), and then, even if a correct signal is given within a preset lock-out time, a correct signal disable circuit (5) will disable the signal so that the correct signal will not be able to enter the driving circuit (7), i.e., the alarm system (8) cannot be disarmed and the lock cannot be opened.

Figure 2:
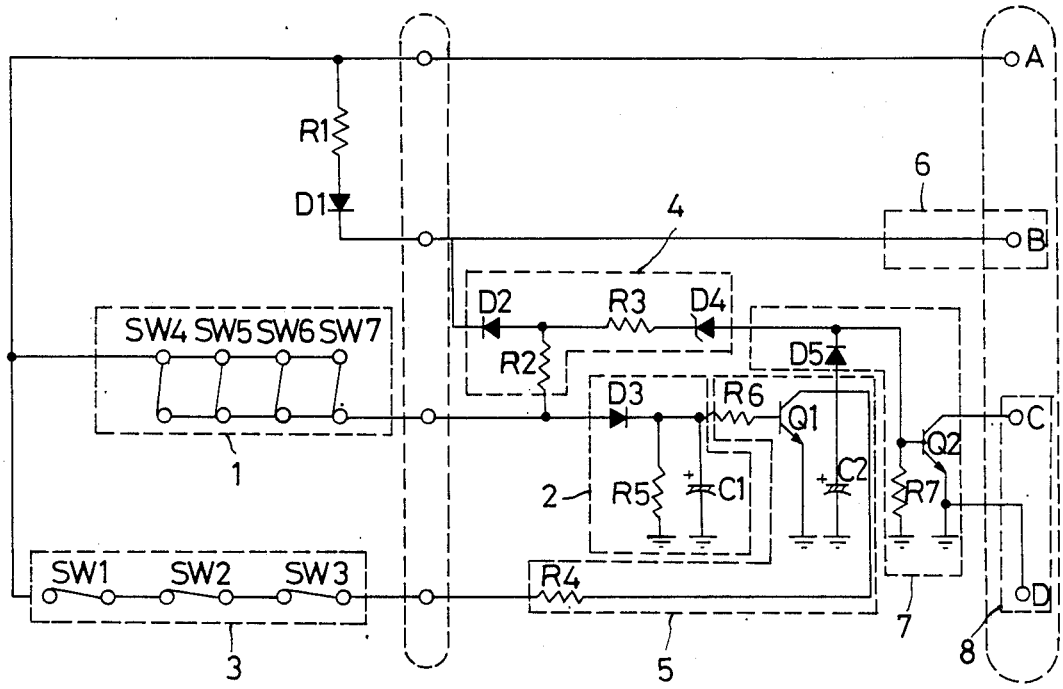
FIG. 2 is a circuit diagram for a preferred embodiment of the present invention.

FIG. 2 is a circuit diagram for the preferred embodiment of the present invention. Point A is an input point for a positive power source. Point B is an arming signal circuit (6) for an alarm system. Points C and D are on/off control points for the alarm sysem. SW1, SW2, and SW3 are correct-signal switches (3). In the present invention, SW1, SW2, and SW3 are connected in series as a correct signal input device. SW4, SW5, SW6, and SW7 are connected in parallel as incorrect signal input devices. The incorrect signal, via R2, R3, and D4, turns Q2 on, and then Q2 activates the alarm system (8). When the switches connected in series are all turned on, a correct signal passes through R4 and D5 to turn Q2 on and arm the alarm system (8). As above, the alarm system is armed. Point B, the arming signal circuit (6), gives a "0" signal to light an LED designated as D1. The "0" signal will pass through D2, R3, and D4. At this moment, even a "1" signal inputted from the parallel set of incorrect-signal generating reed switches will be disabled by D2 and unable to pass through R2 and R3. The incorrect signal will enable the lock-out timer circuit (2), causing the collector Q1 to be negative in the preset lockout time even if there is a correct signal input. Therefore, the alarm cannot be disarmed and the door cannot be opened within the preset lock-out time. If no further false signals are input after the preset lock-out time, the correct signal input will pass R4 and D5 turn Q2 on, disarm the alarm system (8), and open the door. Therefore, the present invention is a device which can facilitate the activation of an alarm system with a keypad while preventing any thief from opening the door and disarming the alarm system by using different combinations of magnets to find the correct signal. It is indeed a reliable, burglarproof device.

What is claimed is:

1. A device to facilitate the activation of an alarm system, including a first set of reed switches operable to generate a correct signal and a second set of reed switches operable to generate an incorrect signal, a driving circuit to arm the alarm system in response to either said correct or said incorrect signal and responsive to said correct signal when the alarm system is armed to disarm the alarm system, and a correct signal disable timing circuit responsive to said incorrect signal to disable said correct signal from disarming the alarm system when the correct signal is given within a preset lock-out time after the receipt of said incorrect signal.

2. A device to facilitate the activation of an alarm system as claimed in claim 1 wherein the first set of correct-signal generating reed switches is composed of a plurality of reed switches connected in series operable to generate said correct signal when all of the switches of said first set are closed.

3. A device to facilitate the activation of an alarm system as claimed in claim 1 wherein the second set of incorrect-signal generating reed switches is composed of a plurality of reed switches connected in parallel operable to generate said incorrect signal when one of the switches of said second set is closed.

* * * * *